US006029033A

United States Patent [19]

Kawasaki

[11] Patent Number: 6,029,033

[45] Date of Patent: Feb. 22, 2000

[54] CLEARLESS COLOR IMAGE FORMING APPARATUS

[75] Inventor: Akihiro Kawasaki, Itami, Japan

[73] Assignee: Minolta Co., Ltd., Osaka, Japan

[21] Appl. No.: 09/258,068

[22] Filed: Feb. 26, 1999

[30] Foreign Application Priority Data

Feb. 27, 1998 [JP] Japan ..... 10-046902

[51] Int. Cl.[7] ..... G03G 15/00; G03G 21/00

[52] U.S. Cl. ..... 399/149; 399/101; 399/299

[58] Field of Search ..... 399/149, 150, 399/51, 53, 99, 101, 223, 299, 302, 349, 55; 430/111

[56] References Cited

U.S. PATENT DOCUMENTS

| | | | |
|---|---|---|---|
| 5,175,591 | 12/1992 | Dunn et al. | 399/349 X |
| 5,701,570 | 12/1997 | Takuma | 399/149 X |
| 5,740,493 | 4/1998 | Otaki et al. | 399/299 X |
| 5,758,038 | 5/1998 | Itoh et al. | 399/101 X |
| 5,784,674 | 7/1998 | Iseki et al. | 399/299 X |
| 5,797,070 | 8/1998 | Waki et al. | 399/149 |
| 5,832,336 | 11/1998 | Kawasaki et al. | 399/149 X |
| 5,864,736 | 1/1999 | Shimada et al. | 399/149 |
| 5,870,650 | 2/1999 | Takahashi et al. | 399/101 X |
| 5,878,312 | 3/1999 | Hisada | 399/149 |
| 5,933,681 | 8/1999 | Suzuki | 399/150 X |

FOREIGN PATENT DOCUMENTS 5-53414 5/1993 Japan .

*Primary Examiner*—Sophia S. Chen
*Attorney, Agent, or Firm*—McDermott, Will & Emery

[57] ABSTRACT

A color image forming apparatus, with image forming units configured as cleanerless, whereby the printing speed and the size reduction can be enhanced while maintaining a high image quality, and characteristics with respect to the environment are improved. The color image forming apparatus includes a plurality of image forming units serially arranged in a straight line. Each image forming unit includes an image carrier, an electrostatic latent image forming device for forming an electrostatic latent image on the image carrier, and a developing device for forming a toner image by applying toner to the electrostatic latent image. The color image forming apparatus further includes an intermediate transfer member to which the toner images from the plurality of image forming units are sequentially transferred in a superimposed fashion, and a transferring device for transferring the superimposed toner images from the intermediate transfer member to a recording medium. At least one of the image forming units is configured as a cleanerless image forming unit, having a developing device of a jumping development system. The cleanerless image forming unit includes a toner holding device for temporarily holding residual toner that remains on the image carrier after transfer of the toner image to the intermediate transfer member, and discharging the held residual toner at a predetermined timing.

12 Claims, 8 Drawing Sheets

CLEARLESS COLOR IMAGE FORMING APPARATUS

This application is based on Japanese Application No. 10-046902, filed Feb. 27, 1998, the content of which is hereby incorporated by reference.

FIELD OF THE INVENTION

The present invention relates to a color image forming apparatus used in a copier, a printer, or the like, and more particularly to a color image forming apparatus in which image forming units are configured so as to be cleanerless, whereby the printing speed and the size reduction can be enhanced while maintaining a high image quality, and characteristics with respect to the environment are improved.

BACKGROUND OF THE INVENTION

FIG. 9 shows an example of a color image forming apparatus of the prior art. The color image forming apparatus 100 is an apparatus of the tandem type in which four image forming units 101Y, 101M, 101C, and 101K for yellow, magenta, cyan, and black are serially arranged. The yellow image forming unit 101Y comprises: (1) a photosensitive drum 102Y; (2) a charger 103Y, which uniformly charges the surface of the photosensitive drum 102Y; (3) a developer 104Y, which develops an electrostatic latent image formed on the photosensitive drum 102Y for forming a toner image; (4) a transfer charger 105Y, which transfers the toner image to a recording member; and (5) a cleaning box 106Y, which recovers and houses residual toner remaining on the image carrier after transfer. Elements (2)–(5) are arranged around the photosensitive drum 102Y, as illustrated. The magenta, cyan, and black image forming units 101M, 101C, and 101K are configured in the same manner. Thus, the magenta, cyan, and black image forming units 101M, 101C, and 101K, include a photosensitive drum 102M, 102C, 102K,, a charger 103M, 103C, 103K, a developer 104M, 104C, 104K, a transfer charge 105M, 105C, 105K, and a cleaning box 106M, 106C and 106K respectively.

An electrostatic latent image of the yellow component is formed on the photosensitive drum 102Y by the yellow image forming unit 101Y. The electrostatic latent image is developed by the developer 104Y to be formed as a toner image, and the toner image is then transferred to a recording member by the transfer charger 105Y. Thereafter, an electrostatic latent image of the magenta component is formed on the photosensitive drum 102M by the image forming unit 101M. The electrostatic latent image is developed by the developer 104M to be formed as a toner image, and the toner image is then superimpose-transferred to the recording member by the transfer charger 105M. The same procedure is then repeated in the image forming units 101C and 101K. Thereafter, toner is fixed to the recording member by a fixing roller 107, thereby copying or recording a desired color image.

The color image forming apparatus 100 of the prior art has a problem in that it is difficult to reduce the size of the apparatus. This problem is produced because the color image forming units 101Y, 101M, 101C, and 101K have the cleaning boxes 106Y, 106M, 106C, and 106K, respectively, and hence the image forming units 101Y, 101M, 101C, and 101K occupy a large volume.

Japanese Patent Publication (Kokai) Ho. HEI5-53414 discloses a color image forming apparatus in which a part of image forming units has a simplified cleaning box so as to have a cleanerless configuration, thereby intending to reduce the size of the apparatus.

In the color image forming apparatus 200 disclosed in Kokai, the size of the apparatus is reduced, but the degree of the size reduction is not sufficient because a part of the image forming units still include a cleaning box. A cleanerless image forming unit requires a non-contact charger (such as a corona discharger), thereby producing a further problem in that ozone is generated, which causes environmental contamination.

SUMMARY OF THE INVENTION

The present invention has been devised in order to solve the foregoing problems in the prior art. It is, therefore, an object of the present invention to provide a color image forming apparatus in which the printing speed and the size reduction can be enhanced while maintaining a high image quality, and characteristics with respect to the environment are improved.

In a first embodiment, the present invention provides a color image forming apparatus comprising a plurality of image forming units. Each image forming unit includes an image carrier; electrostatic latent image forming means, developing means, an intermediate transfer member, transferring means, and a recording member. The electrostatic latent image forming means forms an electrostatic latent image on the image carrier. The developing means applies toner to the electrostatic latent image, and thereby forms a toner image. In a primary transfer, the toner images respectively formed on the image carrier are sequentially superimposed or transferred to the intermediate transfer member. In a secondary transfer, the transferring means transfers the toner images from the intermediate transfer member to the recording member, wherein at least one of the image forming units is a cleanerless image forming unit. The cleanerless image forming unit comprises developing means of a jumping development system, and toner holding means. The jumping development method is a non-contact development method in which toner is caused to jump by applying an AC bias wherein an alternating voltage is superimposed onto a DC voltage. The toner holding means temporarily holds residual toner that remains on the image carrier after transfer to the intermediate transfer member, and then discharges the residual toner at a predetermined timing.

The electrostatic latent image forming means forms an electrostatic latent image is formed on the image carrier, and the developing means develops the electrostatic latent image for forming the toner image. During the primary transfer, the toner image is then transferred to the intermediate transfer member. A toner image of another color is then formed in another image forming unit, and, in another primary transfer, that toner image is superimposed over the previous toner image on the intermediate transfer member. The same procedure is then repeated, so that toner images for the colors yellow, magenta, cyan, and black are superimposed on the intermediate transfer member. During the secondary transfer, the transferring means then transfers the toner images superimposed on the intermediate transfer member to the recording member, and fixed thereto. A desired color image is thereby recorded or copied.

In each of the image forming units, after the toner image is transferred to the intermediate transfer member, toner that has not been transferred (residual toner) remains on the image carrier. The toner holding means recovers the residual toner before the next image formation is started. The residual toner recovered by the toner holding means is discharged at a predetermined timing. In order to maintain a high image quality, the predetermined timing is preferably set to be during a period when an image is not formed. Alternatively, the residual toner may be discharged from the toner holding means when a toner empty, image impairment, or such condition is detected, or in response to a user input.

As described above, the present image forming apparatus provides for a toner holding means that recovers the residual toner remaining on the image carrier after the primary transfer, and discharges the residual toner at a predetermined timing. Even when the image forming units are configured so as to be cleanerless, therefore, residual toner is adequately processed. After discharge, therefore, residual toner does not exist at the exposure position or at the development position on the image carrier, which enhances image quality by preventing impairment of image quality, such as by roughness of a memory image or a dot image, and preventing mixture of toner of different colors. Moreover, each of the image forming units being of a cleanerless configuration results in a reduced size, taking up less space. With the image forming units of the present invention being serially juxtaposed, the printing speed and the size reduction are enhanced.

In a second embodiment, the present invention provides a color image forming apparatus, as in the first embodiment, wherein the toner satisfies conditions of a 0.96–1.0 shape factor. Further, the image forming units of the second embodiment are cleanerless, as in the first embodiment, except that the developing means is a contact development system. With the contact type developing means of the contact development system, when residual toner is discharged from the toner holding means, the toner passes the development position and the development may be adversely affected, lowering the image quality. As a countermeasure, therefore, toner satisfying conditions of a 0.96–1.0 shape factor is used (hereinafter referred to as "spherical toner"). The shape factor is defined as a ratio of the circumference of a projected image of toner to that of the equivalent circle of the projected image of toner. When the shape factor is 1, a complete spherical shape is attained. As the shape factor is further reduced from 1, the sphere shape distorts. A spherical toner ensures a transfer efficiency of substantially 100%. According to this configuration, a very small amount of toner remains on the image carrier after the primary transfer. Residual toner, therefore, can be recovered by the toner holding means, and held until replacement of the developing means. As a result, the image forming units can be configured as cleanerless. The residual toner held in the toner holding means is discharged and processed when the developing means is replaced.

In a third embodiment, the present invention provides a color image forming apparatus, as in the first embodiment, wherein the image forming process is controlled so that, when residual toner discharged from the toner holding means exists at an exposure position and a development position on the image carrier, the image forming process is not executed. This control is performed by the electrostatic latent image forming means and means for controlling the development bias. Specifically, in accordance with the timing of discharging the residual toner, the exposure timing is controlled by the electrostatic latent image forming means. Further, the development bias controlling means controls operations, such as switching the superimposed alternating voltage of the development bias to a DC voltage, switching the development bias to the floating state, and lowering the alternating voltage component to a level at which toner does not jump. According to this configuration, the residual toner discharged from the toner holding means does not exist at the exposure position on the image carrier, preventing impairment of the image quality, such as roughness of a memory image or a dot image. Furthermore, residual toner discharged from the toner holding means passes the development position on the image carrier, and is then processed, without being recovered by the developing means, which prevents mixture of different color toner. Preferably, prior to switching operation from non-image formation to image formation, the discharge and recovery of residual toner in the toner holding means is switched in advance by a time period required for an arbitrary point of the image carrier to pass through the distance between the toner holding means and the development position, whereby, during the image formation, the residual toner is prevented from existing at the exposure position and the development position.

In a fourth embodiment, the present invention provides a color image forming apparatus, as in either of the first three embodiments, wherein the apparatus includes recovering means for recovering residual toner discharged from the toner holding means. Residual toner discharged from the toner holding means and then again carried on the image carrier is recovered by the recovering means. Namely, the residual toner is prevented from adversely affecting the image formation and scattering in the apparatus, thereby ensuring a high image quality.

In a fifth embodiment, the present invention provides a color image forming apparatus, as in the fourth embodiment, wherein the recovering means is a cleaning means that is disposed to contact be in contact with the intermediate transfer member, and the cleaning means comprises rotary cleaning means and stationary cleaning means. The rotary cleaning means and the stationary cleaning means recover the residual toner discharged from the toner holding means. According to this configuration, the residual toner is surely recovered and hence a high image quality is ensured. In some cases, either the rotary cleaning means or the stationary cleaning means may be used. In the case where spherical toner is used, the toner is hardly recovered by the stationary cleaning means, and, therefore, it is preferable to use the rotary cleaning means or both the rotary cleaning means and the stationary cleaning means.

In a sixth embodiment, the present invention provides a color image forming apparatus, as in the fourth or fifth embodiments, wherein a charging means for recharging residual toner discharged from the toner holding means to a normal polarity is disposed upstream from the cleaning means. The charging means may be made of a material that is on a positive side in charge series with respect to residual toner discharged from the toner holding means. Alternatively, the charging means may be made of an electrically conductive material, and a voltage of a polarity that is identical with the normal charge polarity is applied to the charging means. With the color image forming apparatuses of the sixth embodiment, residual toner discharged from the toner holding means is charged to the normal charge polarity by the charging means, and the residual toner is recovered by the cleaning means. At this time, the recovery by the cleaning means is conducted mechanically and electrically so that the residual toner is surely recovered, ensuring a high image quality.

DETAILED DESCRIPTION OF THE PREFERRED EMBODIMENTS

The following provides a detailed description of the preferred embodiments of the color image forming apparatus of the present invention with reference to the accompanying drawings. The embodiments comprise digital color copiers (hereinafter, referred to as "copier") in which the color image forming apparatus of the present invention is employed.

Figure 1:
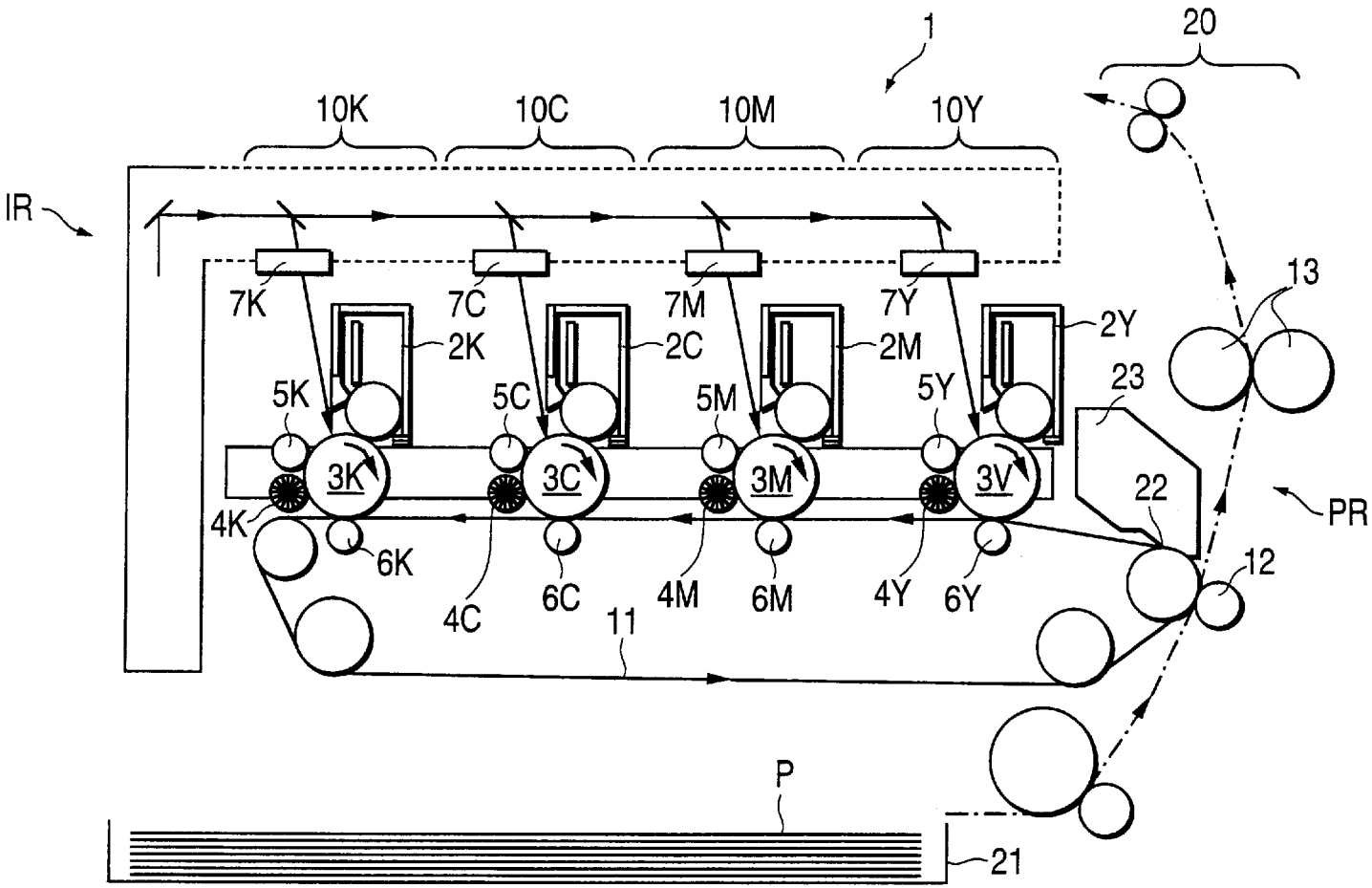
FIG. 1 illustrates the configuration of a color image forming apparatus in accordance with a first embodiment the present invention.

As shown in FIG. 1, the copier of a first embodiment comprises an image reader unit IR that reads an image of an original, and a printer unit PR that reproduces the image on a recording sheet. In the image reader unit IR, a CCD sensor reads image data from light information from that is color-separated into the three primary colors of red (R), green (G), and blue (B), and the image data is arithmetically processed. The printer unit PR comprises a conveying unit 20, four image forming units 10Y, 10M, 10C, and 10K, and an intermediate transfer belt 11. The conveying unit conveys a recording sheet P, and the four image forming units 10Y, 10M, 10C, and 10K respectively form images in the four reproduction colors yellow (Y), magenta (M), cyan (C), and black (K) on the recording sheet P (hereinafter, color codes "Y, M, C, and K" are affixed to reference numerals of components relating the reproduction colors, or yellow, magenta, cyan, and black, respectively). The color image forming apparatus of FIG. 1 is of the tandem type, with the image forming units 10Y, 10M, 10C, and 10K serially arranged in a straight line.

The conveying unit 20 comprises a sheet supply tray 21, a secondary transfer roller 12, a fixer roller 13, and plural conveying rollers. The sheet supply tray accommodates the recording sheet P, and the secondary transfer roller 12 transfers a superimposed transfer toner image formed on the intermediate transfer belt 11 to the recording sheet P. The fixing roller 13 fixes the transferred toner image on the recording sheet P, and the plural conveying rollers feed out the recording sheet P at a predetermined timing and constant speed.

The image forming units 10Y, 10M, 10C, and 10K form the image by means of the electrostatic copying process. The image forming units comprise the photosensitive drums 3Y, 3M, 3C, and 3K, which are serially arranged. Arranged around the photosensitive drums 3Y, 3M, 3C, and 3K are charging brushes 4Y, 4M, 4C, and 4K, which uniformly charge the surfaces of the photosensitive drums 3Y, 3M, 3C, and 3K, respectively. The laser heads 7Y, 7M, 7C, and 7K form desired electrostatic latent images on the photosensitive drums 3Y, 3M, 3C, and 3K in accordance with the image data. The developers 2Y, 2M, 2C, and 2K cause toner to jump to the electrostatic latent images, developing the toner images. The holding rollers 5Y, 5M, 5C, and 5K temporarily hold toner remaining on the photosensitive drums 3Y, 3M, 3C, and 3K after the development. In other words, copier 1 is of the tandem type wherein the four cleanerless image forming units are serially arranged in a straight line so that the printing speed and the size reduction of the apparatus are enhanced.

The primary transfer rollers 6Y, 6M, 6C, and 6K, arranged immediately below the photosensitive drums 3Y, 3M, 3C, and 3K, serially perform the primary transfer of the developed toner images from the photosensitive drums 3Y, 3M, 3C, and 3K to the intermediate transfer belt 11 in a superimposed fashion. The intermediate transfer belt 11 is an endless belt having a surface resistivity of about $10^6$ to $10^8$ ohms/□. The cleaner box 23 is disposed between the secondary transfer roller 12 and the primary transfer roller 6Y. The cleaner box 23 has a cleaning blade 22 that removes and recovers residual toner discharged from the holding rollers 5, and toner remaining on the intermediate transfer belt 11 after the secondary transfer.

The following provides a description of the operation of the copier 1. First, a control unit of the copier 1 conducts image arithmetic processes such as shading correction, density conversion, and edge enhancement. The arithmetic processes are performed based on the intensity levels of light information of images for color components of red (R), green (G), and blue (B) obtained by the image reader unit IR. Thereafter, the light information is converted into writing image data of the reproduction colors, yellow (Y), magenta (M), cyan (C), and black (K), and the image data of yellow (Y), magenta (M), cyan (C), and black (K) are temporarily stored in the control unit.

Thereafter, the laser heads 7Y, 7M, 7C, and 7K, respectively corresponding to the reproduction colors, emit laser beams that are modulated on the basis of the image data stored in the control unit. The photosensitive drums 3Y, 3M, 3C, and 3K are rotated in the direction of the arrow in FIG. 1 so that their surfaces are uniformly charged by means of the charging brushes 4Y, 4M, 4C, and 4K, and then exposed and scanned by the laser beams. The exposure forms electrostatic latent images on the photosensitive drums 3Y, 3M, 3C, and 3K which correspond to the reproduction colors. The electrostatic latent images are to be developed by means of the developers 2Y, 2M, 2C, and 2K, which contain toner of the reproduction colors, respectively. The electrostatic latent images are thereby converted into toner images of the reproduction colors. These toner images are sequentially transferred to the intermediate transfer belt 11, in a superimposed fashion, by the primary transfer rollers 6Y, 6M, 6C, and 6K at the portions where the photosensitive drums 3Y, 3M, 3C, and 3K are opposed to the intermediate transfer belt 11. Thereafter, the toner images are conveyed to the portion where the secondary transfer roller 12 is opposed to the belt. In a secondary transfer, the toner images are transferred, by the secondary transfer roller 12, from the intermediate transfer belt to the recording sheet P supplied from the sheet supply tray 21. Thereafter, the recording sheet P to which the toner images are transferred is conveyed to the fixing roller 13 to be heated, and the toner images of the colors are melted to be formed as a full-color image and fixed onto the recording sheet P.

Residual toner, which remains on the photosensitive drums 3Y, 3M, 3C, and 3K after the primary transfer to the intermediate transfer belt 11, is recovered by the holding rollers 5Y, 5M, 5C, and 5K. Further, residual toner discharged from the holding rollers 5Y, 5M, 5C, and 5K, and toner that remains on the intermediate transfer belt 11 after the secondary transfer, is recovered into the cleaner box 23.

Figure 2:
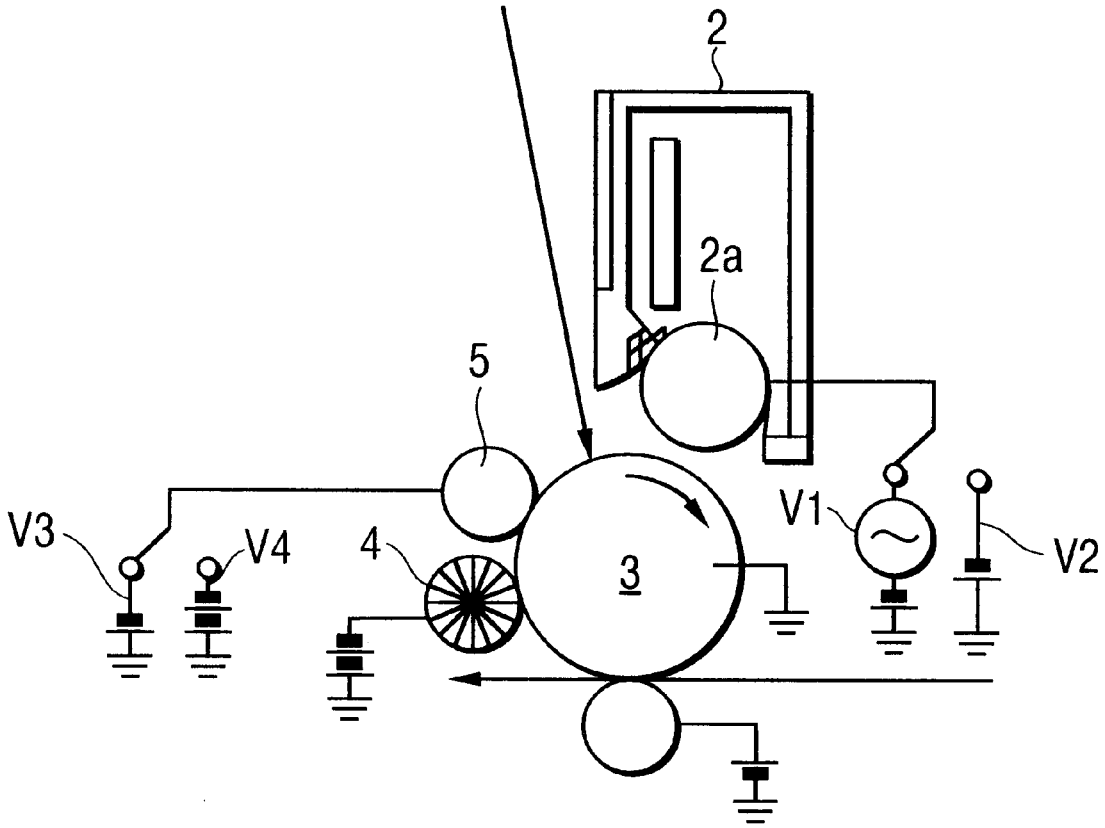
FIG. 2 illustrates the configuration of an image forming unit in accordance with the present invention.

The process concerning the residual toner on the photosensitive drum in each of the image forming units, which are configured as cleanerless, is now described in more detail with reference to FIG. 2. Since each of the image forming units are configured in the same manner, the following description, which omits particular color codes, applies to each of the image forming units.

First, a voltage of −1,200 V is applied to the charging brush 4 to charge the surface of the photosensitive drum 3 to about −700 V, and a voltage of about −300 V is applied to the holding roller 5. At this time, residual toner remaining on the photosensitive drum 3 after the primary transfer is charged to a negative polarity, and hence all of the residual toner is recovered by the holding roller. As a result, no toner exists at the exposure position on the photosensitive drum 3, and thus impairment of the image quality, such as roughness of a memory image or a dot image, does not occur.

The developer 2 develops the electrostatic latent image. Specifically, a development bias, in which an AC component of an amplitude of 1,500 V and a frequency of 2 kHz, is superimposed on a DC voltage of −300 V, and is applied to a developing roller 2*a*. The development gap of the developing roller is set at 200 micrometers or greater than the toner layer. As a result, the toner layer formed on the developing roller 2*a* jumps in the developing region for application to the electrostatic latent image, and the electrostatic latent image on the photosensitive drum 3 is developed to form a toner image.

In the development on the photosensitive drum 3, a sufficient density can be ensured by supplying toner of an amount of about 0.9 mg/cm$^2$, and a high transfer efficiency can be obtained by applying an appropriate transfer voltage to the intermediate transfer belt 11. In the embodiment, a transfer voltage of +500 V is applied to the primary transfer roller 6. The primary transfer is conducted on the intermediate transfer belt 11 because the toner image is not directly transferred to the recording sheet P and hence a high transfer efficiency can be maintained. When a high transfer efficiency is ensured, it is possible to reduce the amount of residual toner on the photosensitive drum 3 after the primary transfer. Accordingly, when a cleaner box for recovering residual toner is not provided for each of the image forming units, residual toner can be recovered only by the holding rollers 5.

The following description considers the case where a sheet of A3 size is used, wherein the print length in the sheet feeding direction is 40 cm, and a solid image is transferred to the whole face. The transfer efficiency is 90%. Since the amount of toner used in the development is 0.9 mg/cm$^2$ and the transfer efficiency is 90%, the amount of toner which is actually used in the development is 32.4 mg/cm. Therefore, the amount of residual toner remaining on the photosensitive drum 3 is 3.6 mg/cm. The holding roller 5 has an outer diameter of 16 mm, and hence the amount of toner to be recovered by the holding roller 5 is 0.72 mg/cm$^2$. Since the number of layers of residual toner is two or less, the toner can be sufficiently carried by the holding roller 5.

During a period when an image is not being formed, residual toner recovered by the holding roller 5 must be discharged for processing. When a toner image is superimposed by the primary transfer roller 6, the toner contacts with another toner image of a different color, and hence mixture of toner of different colors occurs to some extent. Accordingly, unlike with a cleanerless monochrome image forming unit, residual toner cannot be returned to the developer. Therefore, the development bias is controlled in such a manner that, before residual toner discharged from the holding roller 5 reaches the development position, the AC component of the development bias is turned off to set the bias so as to consist of the DC component only. Residual toner discharged from the holding roller 5 passes the development position without being recovered by the developer 2. Mixture different color toners is thereby prevented.

Figure 3:
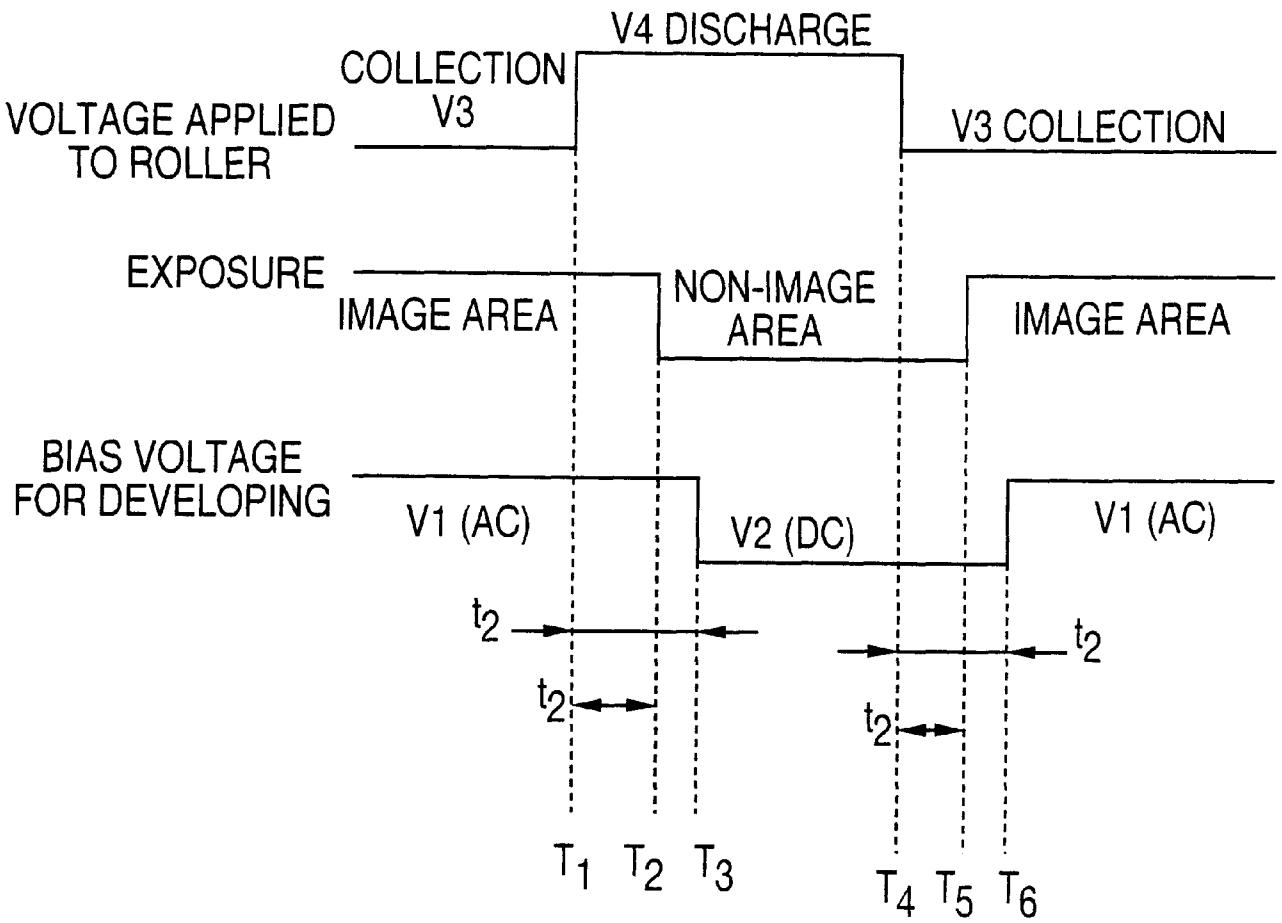
FIG. 3 is a control timing chart of the image forming process.

The timing chart of FIG. 3 illustrates the control of the development bias. The image forming process occurs before time $T_1$. Specifically, the exposure scan is conducted by the laser head 7 to form the electrostatic latent image, and the developer 2 applies an AC voltage V1 as the development bias. A voltage V3 is applied to the holding roller 5, and residual toner from after the primary transfer is recovered.

At time $T_1$, the voltage applied to the holding roller 5 is switched to a voltage V4, and the discharge of residual toner is started. After elapse of a period $t_1$ from time $T_1$, or at time $T_2$, the exposure scan by the laser head 7 is ended. The period $t_1$ is the time period required for an arbitrary point of the photosensitive drum 3 to move from the position where the drum is opposed to the holding roller 5 to the exposure position. Immediately before residual toner discharged from the holding roller 5 onto the photosensitive drum 3 reaches the exposure position, i.e., at time $T_2$, the exposure scan by the laser head 7 is ended. Residual toner discharged from the holding roller 5 does not exist at the exposure position on the photosensitive drum 3 during the exposure scan by the laser head 7. Therefore, impairment of the image quality, such as roughness of a memory image or a dot image is prevented from occurring.

After elapse of a period $t_2$ from time $T_1$, or at time $T_3$, the development bias is switched over from the AC voltage V1 to a DC voltage V2. The period $t_2$ is a time period required for an arbitrary point of the photosensitive drum 3 to move from the position where the drum is opposed to the holding roller 5 to the development position. Immediately before residual toner discharged from the holding roller 5 onto the photosensitive drum 3 reaches the development position, i.e., at time $T_3$, the development bias is switched over from the AC voltage V1 to the DC voltage V2. Residual toner discharged from the holding roller 5 surely passes the development position without being recovered by the developer 2. Mixture of toner of different colors is thereby prevented from occurring.

The residual toner discharged from the holding roller 5 that has passed the development position as described above is charged to a negative polarity. On the other hand, a voltage of +500 V is applied to the primary transfer roller 6. The residual toner is thus transferred to the intermediate transfer belt 11, and then removed by the cleaning blade 22 for storage in the cleaning box 23.

At time $T_4$, the voltage applied to the holding roller 5 is again switched to the voltage V3, the discharge of residual toner is ended, and the recovery is started. After elapse of the period $t_1$ from time $T_4$, or at time $T_5$, the exposure scan by the laser head 7 is conducted. Then, after elapse of the period $t_2$ from time $T_5$, or at time $T_6$, the development bias is switched over from the DC voltage V2 to the AC voltage V1, and the image forming process is again conducted. The above-described process for the residual toner is repeatedly executed to adequately process residual toner. According to this embodiment, a cleaning box for recovering residual toner for each of the image forming units is not needed, resulting in cleaner less image forming units.

As described above, in the copier 1, the holding roller 5 temporarily holds the residual toner remaining on the photosensitive drum 3 after the primary transfer, and the residual toner is discharged from the holding roller 5 at a predetermined timing. The discharged residual toner is recovered in the cleaner box 23, which is disposed on the intermediate transfer belt 11. The image forming units 10 can, therefore, be configured as cleaner less, while maintaining a high image quality, and occupying a smaller volume reducing the size of the apparatus. Further, since the copier 1 is of the tandem type, the printing speed can be enhanced, and the charging brushes 4 and the transfer rollers 6 and 12, which are of the contact type, and thus environmental contamination due to generation of ozone does not occur.

The foregoing embodiment is provided as one example, and is not intended to restrict the scope of the invention. Various modifications and improvements may be implemented without departing from the sprit of the invention. For example, the foregoing embodiment uses developers of the jumping development type as the developers 2Y, 2M, 2C, and 2K. The yellow component, which is the first component subjected to the primary transfer to the intermediate transfer belt 11, will not be mixed with other color components. With respect to the yellow component, therefore, a developer of the contact development system may be used. The holding roller 5 may be disposed on either of the upstream or downstream sides of the charging brush 4, and may be contacted or integrated with the charging brush 4. In place of the charging brush 4, a film, a blade, a roller, or the like may be used, or, in place of the holding roller 5, a fiber brush, a magnetic brush, a film, a blade, or the like may be used.

Figure 4:
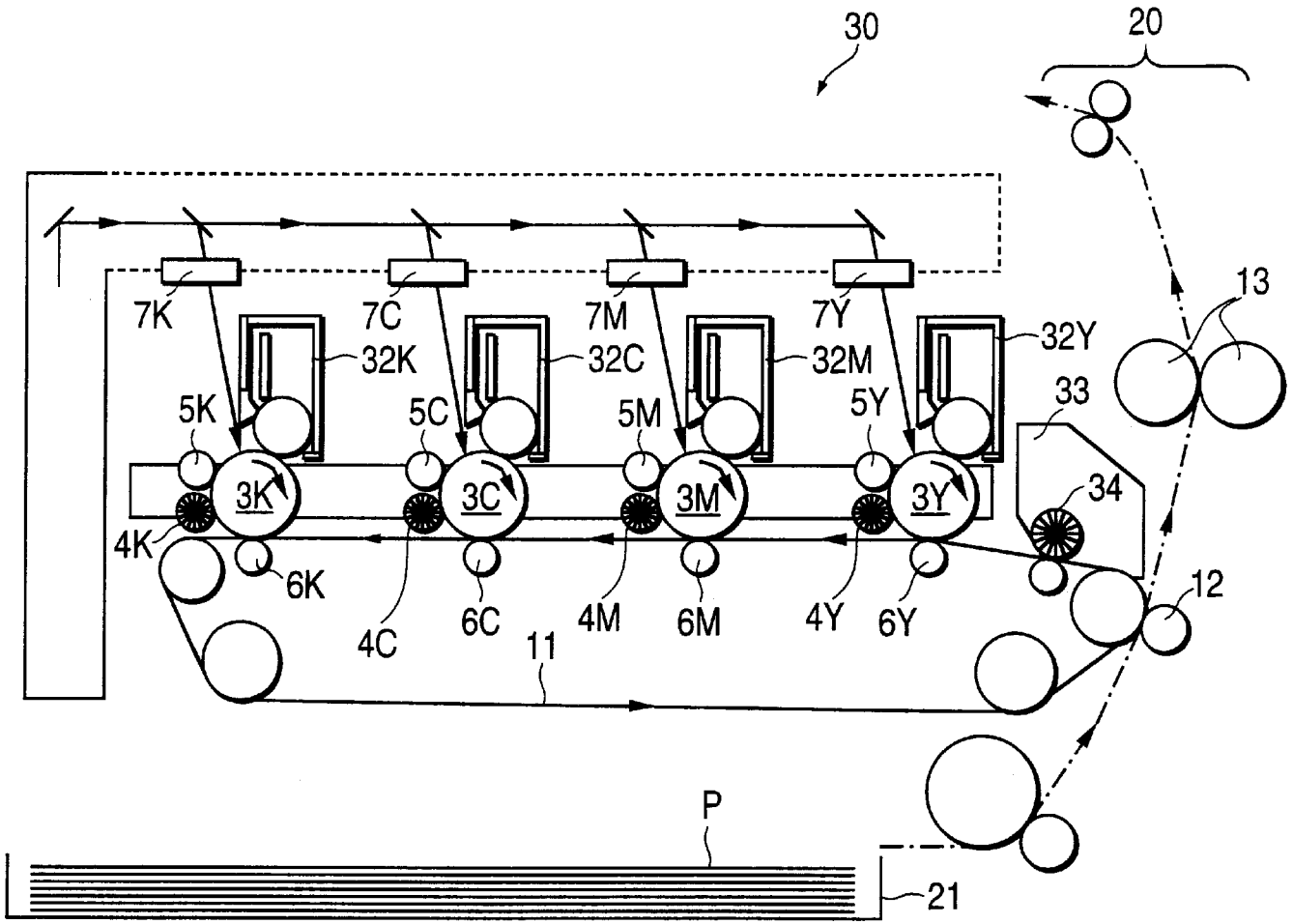
FIG. 4 illustrates the configuration of a color image forming apparatus in accordance with a second embodiment the present invention.

As shown in FIG. 4, the copier of a second embodiment comprises the basic structure as that of the first embodiment described above, except that the developer units 32K, 32C, 32M, and 32Y, and cleaning box 33 are configured in a slightly different manner. Particularly, in this embodiment, the developers are of the contact development system type, the toner is nonmagnetic, single-component spherical toner (having a mean particle diameter of 8 micrometers), and the cleaning box 33 includes rotary brush 34. The components in common with the first embodiment are denoted by the same reference numerals and are configured and operate as described above.

Figure 5:
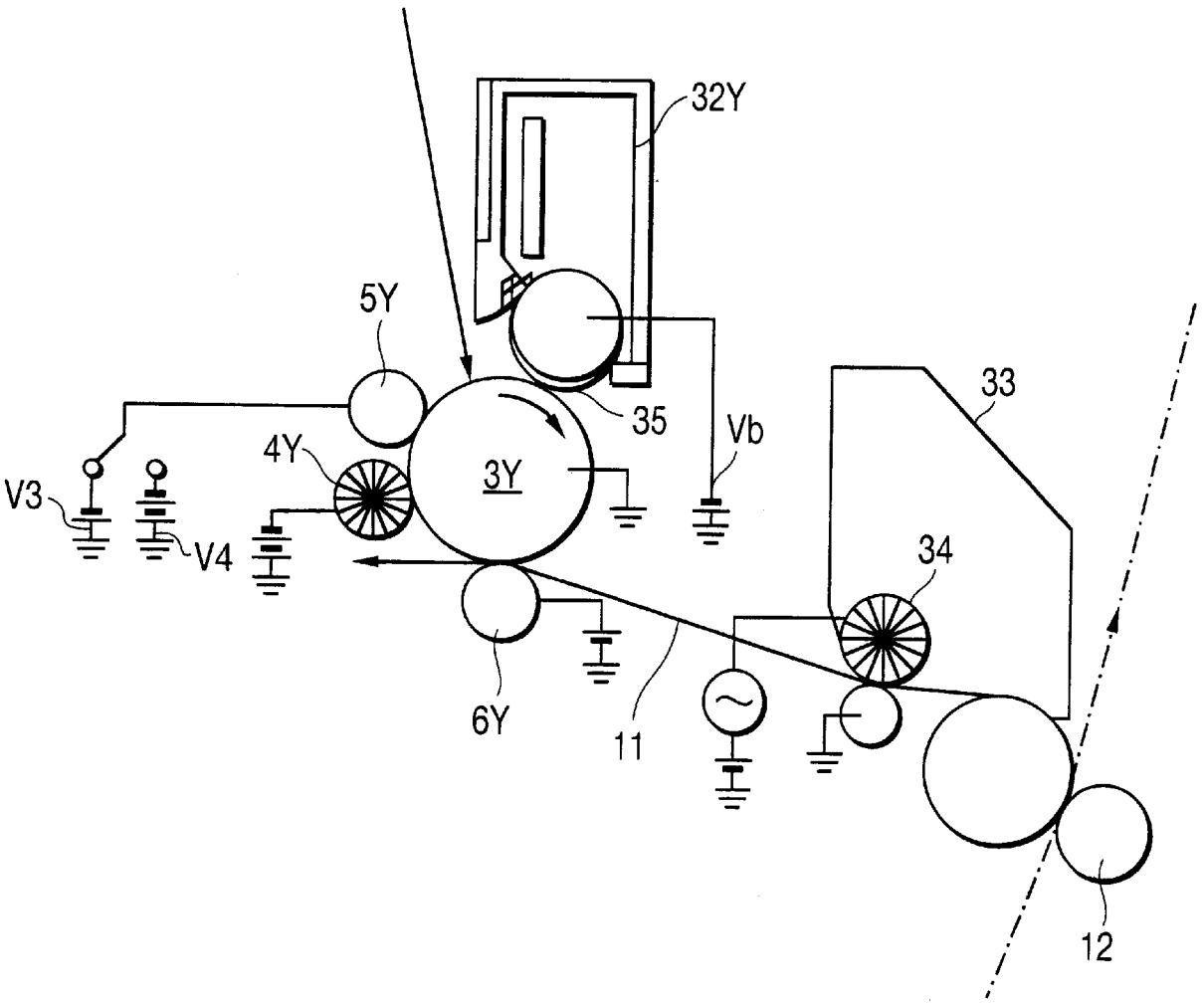
FIG. 5 illustrates the configuration of an image forming unit and a cleaner box.

Referring to FIG. 5, each of the image forming units of the copier 30 are configured and operate in the same manner, and thus the following description for the image forming unit 3Y for yellow (Y) applies to all the image forming units.

First, a voltage of −1,200 V is applied to the charging brush 4Y to charge the surface of the photosensitive drum 3Y to about −700 V, and a voltage V3 of about −300 V to the holding roller 5Y. At this time, the residual toner from after the primary transfer is charged to a negative polarity, and hence all of the residual toner is recovered by the holding roller 5Y. Therefore, no toner exists at the exposure position on the photosensitive drum 3Y, preventing impairment of the image quality, such as roughness of a memory image or a dot image. The electrostatic latent image is developed by the developer 32Y. Specifically, a development bias Vb is applied to the developer 32Y, so that the toner layer formed on a developing sleeve 35 is applied to the electrostatic latent image in the developing region. As a result, the electrostatic latent image formed on the photosensitive drum 3Y is developed to form a toner image.

In the development on the photosensitive drum 3Y, a sufficient density can be ensured by supplying toner of an amount of about 0.9 mg/cm$^2$, and a high transfer efficiency can be obtained by applying an appropriate transfer voltage to the intermediate transfer belt 11. Therefore, a transfer voltage of +500 V is applied to the primary transfer roller 6Y. Ensuring a high transfer efficiency enables a reduction of the amount of residual toner on the photosensitive drum 3Y after the primary transfer.

In the developer 2Y, because the developing sleeve 35 is contacted with the photosensitive drum 3Y, residual toner discharged from the holding roller 5Y is recovered by the developer 2Y. Therefore, the problem of color mixture does not arise in the image forming unit for yellow (Y), which is the first unit performing the primary transfer onto the intermediate transfer belt 11. The problem of color mixture in the image forming units, however, arises for magenta (M), cyan (C), and black (K), which are arranged in succession to the unit for yellow (Y).

In this embodiment, therefore, spherical toner is used so that a transfer efficiency of substantially 100% is attained, and, after the primary transfer, almost no toner remains on the photosensitive drum 3Y. Residual toner can thereby be recovered by the holding roller 5Y until the life cycle of the developer 2. When the developer 2Y is replaced, the residual toner is discharged from the holding roller 5Y, and then recovered by the cleaning box 33, which has the rotary brush 34, via the intermediate transfer belt 11. This is conducted because, with the spherical toner used, the residual toner on the intermediate transfer belt 11 is hardly removed by a blade. In order to enhance the removal efficiency, a voltage in which an AC component of an amplitude of 100 V and a frequency of 2 kHz, superimposed on a voltage of a DC component of −500 V, is applied to the rotary brush. As a result, residual toner on the intermediate transfer belt 11 is surely removed and stored in the cleaning box 33.

As described above, in this embodiment, the toner must be spherical to prevent impairment of the image quality. Table 1 lists the image quality results sampled from images reproduced from different shaped toners. The image quality was measured on a sliding scale of 1–5, with 1 signifying good quality and 5 signifying poor quality.

TABLE 1

| SHAPE FACTOR | IMAGE QUALITY |
|---|---|
| 0.94 | 3 |
| 0.95 | 2 |
| 0.96 | 1 |
| 0.985 | 1 |
| 0.995 | 1 |

As is apparent from Table 1, as the shape factor SF of the toner decreases, impairment of the image quality increases. When the shape factor SF is 0.96 or more, impairment of the image quality does not occur and a high image quality is ensured. Therefore, toner of a shape factor SF from 0.96 to 1.0 can be used as spherical toner. More preferably, the shape factor SF should be close as possible to 1.0.

As described above, in the copier 30 of the second embodiment, spherical toner is housed in the developer 2 of the contact development system, and thus a transfer efficiency of substantially 100% is obtained. Consequently, only a minute amount of residual toner remains on the photosensitive drum 3 after the primary transfer, and the residual toner is recovered by the holding roller 5 and held for the life cycle of the developer 2. Mixture of toners of different colors is thereby prevented from occurring. Therefore, the image forming units can be configured as cleaner less while maintaining a high image quality, and occupying a smaller volume for reducing the size of the apparatus. Because the copier 30 is of the tandem type, the printing speed can be enhanced, and, because the charging brushes 4 and the transfer rollers 6 and 12 are of the contact type, environment contamination by ozone is prevented.

The foregoing second embodiment is provided as another example, and is not intended to restrict the scope of the invention. Various modifications and improvements may be implemented without departing from the sprit of the invention. In the second embodiment, for example, the positional relationship of the arrangement of the charging brush 4 and the holding roller 5 may be inverted. Because the intermediate transfer belt 11 is interposed, the primary transfer voltage can be suppressed to a low level. Consequently, there is a minimal chance that the charge polarity of residual toner on the photosensitive drum 3Y will be inverted, and thus there is virtually no chance that the recovery capability of the holding roller 5 will be diminished. The holding roller 5 is used as the holding means for residual toner. Alternatively, the holding roller 5 may be eliminated, and an AC voltage may be applied to the charging brush 4 so that the brush performs both charging of the photosensitive drum 3 and recovery of residual toner.

Figure 6:
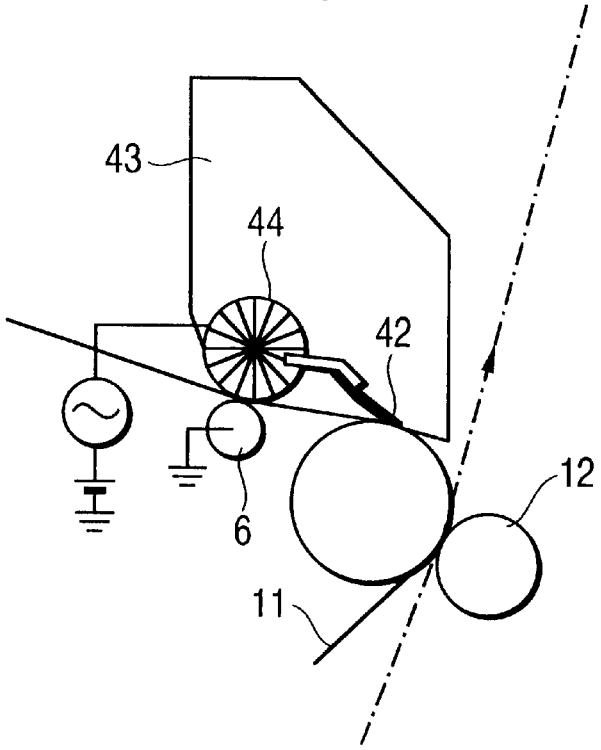
FIG. 6 illustrates the configuration of a cleaner box in accordance with a third embodiment of the present invention.

A copier of a third embodiment of the present invention is structured as the copier 30 of the second embodiment, except for the configuration of the cleaning box. As shown in FIG. 6, the cleaning box 43 comprises a rotary cleaning brush 44 and a cleaning blade 42.

Also, in the same manner as the second embodiment, toner images formed on the photosensitive drums 3 are sequentially transferred to the intermediate transfer belt 11, by the primary transfer rollers 6. The toner images are transferred in a superimposed fashion, at portions where the photosensitive drums 3 are opposed to the intermediate transfer belt 11. Thereafter, the toner images are conveyed to the portion where the secondary transfer roller 12 is opposed to the belt. In the secondary transfer, the toner images on the intermediate transfer belt 11 are transferred to the recording sheet P, supplied from the sheet supply tray 21, by the secondary transfer roller 12. Thereafter, the recording sheet P is conveyed to the fixing roller 13, and is heated to fix the toner images onto the recording sheet P.

Residual toner that remains on the photosensitive drums 3 after the primary transfer to the intermediate transfer belt 11 is recovered into the holding rollers 5, and discharged from the holding rollers 5. Toner that remains on the intermediate transfer belt 11 after the secondary transfer to the recording sheet P is recovered by the cleaner box 43.

When the transfer efficiency of the secondary transfer of the toner images from the intermediate transfer belt 11 to the recording sheet P is very low, cleaning cannot be sufficiently conducted by only one of either a rotary cleaning means or a stationary cleaning means, thereby causing impairment of the image quality. For example, the efficiency of the secondary transfer is lowered when the resistance of the secondary transfer roller 12 or the intermediate transfer belt 11 is changed, or when a very rough recording member is used. Therefore, the cleaning box 43 of the present embodiment comprises the rotary cleaning brush 44 and the cleaning blade 42.

Initially, the cleaning blade 42 mechanically removes most of the residual toner remaining on the intermediate transfer belt 11, and also removes paper dust and other foreign materials. Then the rotary cleaning brush 44, which is charged with a voltage of a 100 V AC component and a frequency of 2 kHz superimposed on a DC component of −500 V, mechanically and electrically removes any residual toner that was left by the cleaning blade 42. As a result, even when the efficiency of the secondary transfer is lowered and a large amount of residual toner remains on the intermediate transfer belt 11, the residual toner is surely removed and recovered by the cleaning box 43. Impairment of the image quality is thereby prevented from occurring.

As described above, according to the copier of the third embodiment, toner remaining on the intermediate transfer belt 11 after the secondary transfer is surely removed. As a result, impairment of the image quality is prevented from occurring and a high image quality is maintained. Further, because the image forming units are configured as cleaner less and arranged serially in a straight line, apparatus size reduction and printing speed are enhanced. Moreover, because the charging brushes 4 and the transfer rollers 6 and 12 are of the contact type, the present embodiment prevents environmental contamination by ozone.

The foregoing third embodiment is provided as another example, and is not intended to restrict the scope of the invention. Various modifications and improvements may be implemented without departing from the sprit of the invention. In the third embodiment, for example, toner remaining on the intermediate transfer belt 11 has charge properties of both positive and negative polarities. Therefore, a voltage with a superimposed AC component is applied to the rotary cleaning brush 44. Even when an AC component is not superimposed, however, the same removal effect can be attained by employing one of the configurations decried below.

Figure 7:
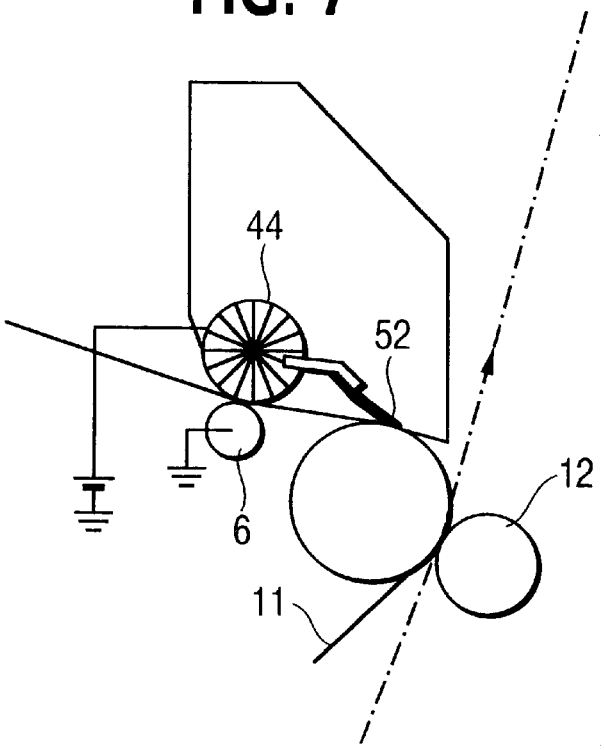
FIG. 7 illustrates a first alternative to the cleaner box of FIG. 6.

In a first configuration, as shown in FIG. 7, a nylon sheet 52, which charges residual toner remaining on the intermediate transfer belt 11 after the secondary transfer to a normal polarity, is disposed upstream from the rotary cleaning brush 44. A DC voltage of +500 V is applied to the rotary cleaning brush 44. When the toner passes over the nylon sheet 52, therefore, all of the toner remaining on the intermediate transfer belt 11 after the secondary transfer is charged to the negative polarity, which is the normal polarity. The cleaning brush 44 thereby surely recovers by the residual toner. The member 52 disposed upstream from the rotary cleaning brush 44 is not restricted to a nylon sheet, and may be composed of a material such as silicone rubber, which can charge toner to the normal polarity, or may be configured as a roller, a blade, or the like, in place of a sheet.

Figure 8:
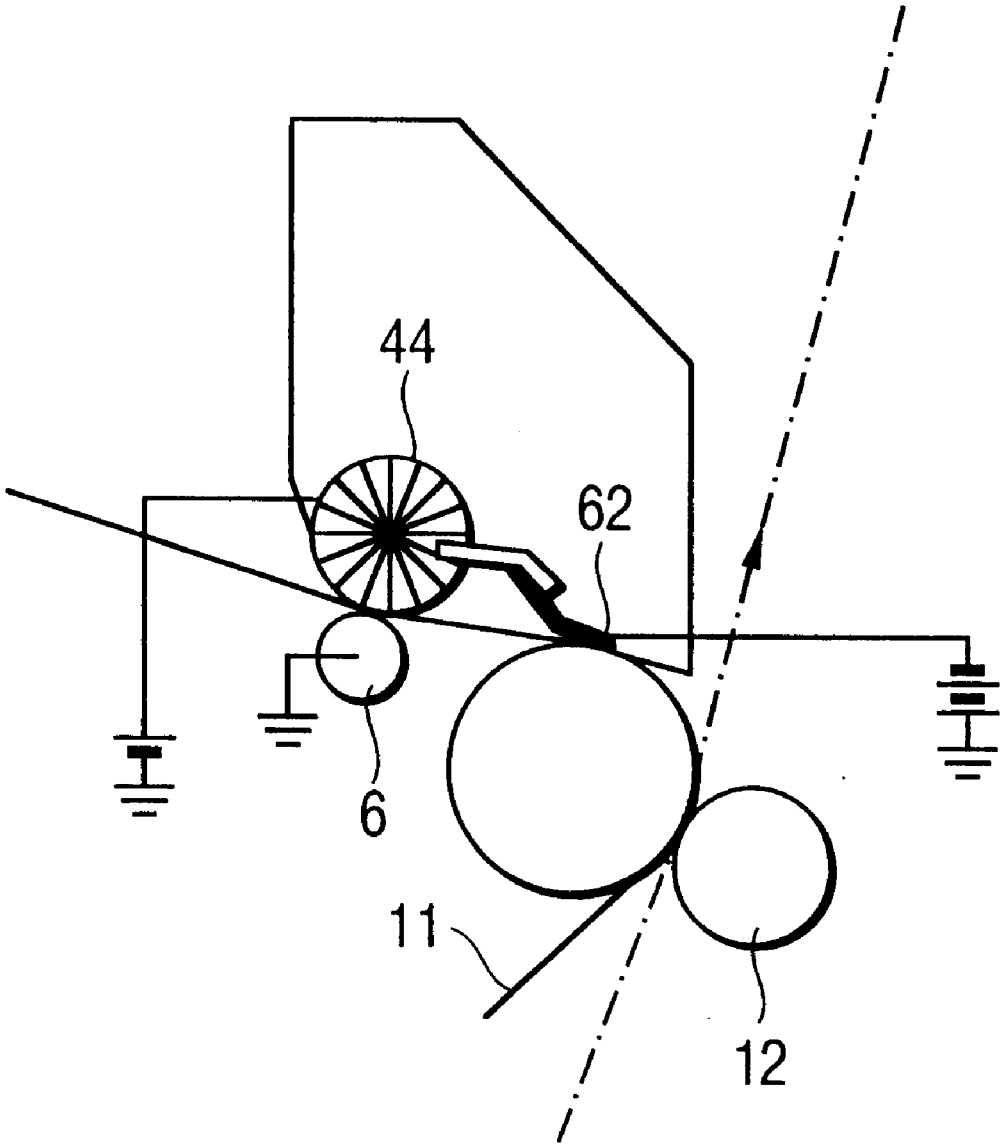
FIG. 8 illustrates a second alternative to the cleaner box of FIG. 6.
Figure 9:
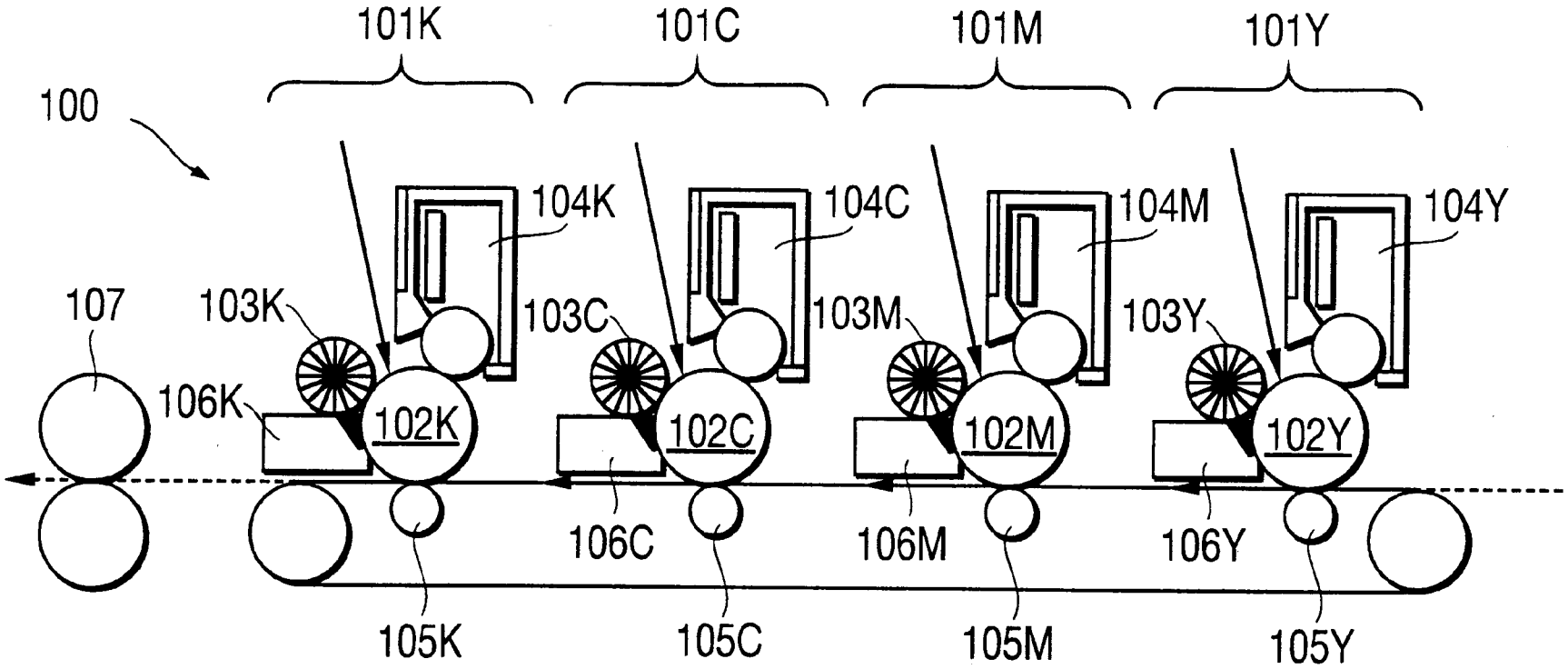
FIG. 9 (PRIOR ART)
FIG. 9 illustrates the configuration of a prior art color image forming apparatus.

In a second configuration, as shown in FIG. 8, an electrically conductive sheet 62 is disposed upstream from the rotary cleaning brush 44. A DC voltage of −1,000 V is applied to the conductive sheet 62, and a DC voltage of +500 V is applied to the rotary cleaning brush 44. When the toner passes over the conductive sheet 62, therefore, all of the toner remaining on the intermediate transfer belt 11 after the secondary transfer is charged to the negative polarity, which is the normal polarity. The rotary cleaning brush 44 thereby surely recovers the residual toner. The member 62 disposed upstream from the rotary cleaning brush 44 is not restricted to a sheet-like member, and may be configured as a roller, a blade, or the like.

Of course, it should be understood that a wide range of modifications can be made to the exemplary embodiments described above. It is therefore intended that the foregoing detailed description be regarded as illustrative rather than limiting and that it be understood that it is the following claims, including all equivalents, which are intended to define the scope of the present invention.

We claim:

1. A color image forming apparatus comprising:

a plurality of image forming units serially arranged in a straight line, each image forming unit comprising an image carrier, electrostatic latent image forming means for forming an electrostatic latent image on the image carrier, and developing means for forming a toner image by applying toner to the electrostatic latent image;

an intermediate transfer member to which the toner images from the plurality of image forming units are sequentially transferred in a superimposed fashion; and transferring means for transferring the superimposed toner images from the intermediate transfer member to a recording medium; and wherein at least one of said image forming units is configured as a cleanerless image forming unit having a developing means of a jumping development system to which a development bias including an AC component is applied, said cleaner less image forming unit having a toner holding means for temporarily holding residual toner that remains on the image carrier after transfer of the toner image to the intermediate transfer member, and discharging the held residual toner at a predetermined timing, and wherein the AC component is switched off before residual toner discharged from said toner holding means onto the image carrier reaches a development position.

2. The color image forming apparatus according to claim 1, wherein an image forming process is controlled such that, when residual toner discharged from the toner holding means exists at an exposure position and the development position on the image carrier, the image forming process is not executed.

3. The color image forming apparatus according to claim 1, wherein the toner holding means comprises a holding roller disposed adjacent to the image carrier, said holding roller being connected to a voltage source.

4. A color image forming apparatus comprising:

a plurality of image forming units serially arranged in a straight line, each image forming unit comprising an image carrier, electrostatic latent image forming means for forming an electrostatic latent image on the image carrier, and developing means for forming a toner image by applying toner to the electrostatic latent image;

an intermediate transfer member to which the toner images from the plurality of image forming units are sequentially transferred in a superimposed fashion; and transferring means for transferring the superimposed toner images from the intermediate transfer member to a recording medium; and wherein said toner is of a shape factor of approximately 0.96 to 1.0, said image forming units are configured as cleaner less image forming units, each comprising a developing means of a contact development system, and a toner holding means for temporarily holding residual toner that remains on the image carrier after transfer of the toner image to the intermediate transfer member, and the residual toner is discharged from said toner holding means onto the image carrier when said developing means is replaced.

5. The color image forming apparatus according to either of claims 1, 2, and 4, wherein said color image forming apparatus further comprises a cleaning means for recovering residual toner discharged from said toner holding means.

6. The color image forming apparatus according to claim 5, wherein said cleaning means is disposed in contact with the intermediate transfer member.

7. The color image forming apparatus according to claim 6, wherein said cleaning means comprises a rotary cleaning means and a stationary cleaning means.

8. The color image forming apparatus according to claim 7, wherein the rotary cleaning means comprises a cleaning brush disposed in contact with the intermediate transfer member and connected to a voltage source, and the stationary cleaning means comprises a cleaning blade disposed in contact with the intermediate transfer member.

9. The color image forming apparatus according to claim 6, further comprising a charging means disposed upstream from the cleaning means, said charging means for recharging residual toner discharged from the toner holding means to a normal polarity.

10. The color image forming apparatus according to claim 9, wherein said charging means is made of a material that is on a positive side in charge series with respect to the residual toner discharged from the toner holding means.

11. The color image forming apparatus according to claim 9, wherein said charging means is made of an electrically conductive material, and a voltage of a polarity that is identical with a polarity of the normal charge is applied to the charging means.

12. The color image forming apparatus according to claim 4, wherein the toner holding means comprises a holding roller disposed adjacent to the image carrier, said holding roller being connected to a voltage source.

* * * * *